United States Patent [19]

Yamada et al.

[11] Patent Number: 4,647,528

[45] Date of Patent: Mar. 3, 1987

[54] SILVER HALIDE PHOTOGRAPHIC MATERIAL

[75] Inventors: Sumito Yamada; Taku Nakamura, both of Kanagawa; Shuzo Suga, Shizuoka; Hiroshi Kawamoto, Kanagawa, all of Japan

[73] Assignee: Fuji Photo Film Co., Ltd., Japan

[21] Appl. No.: 651,368

[22] Filed: Sep. 17, 1984

[30] Foreign Application Priority Data

Sep. 16, 1983 [JP] Japan ..... 58-170975

[51] Int. Cl.[4] ..... G03C 1/02; G03C 1/30; G03C 1/76

[52] U.S. Cl. ..... 430/567; 430/539; 430/569; 430/621

[58] Field of Search ..... 430/569, 621, 539

[56] References Cited

U.S. PATENT DOCUMENTS

| | | | |
|---|---|---|---|
| 3,057,723 | 10/1962 | Jeffreys et al. | 430/621 |
| 3,362,827 | 1/1968 | Oishi et al. | 430/626 |
| 3,396,029 | 8/1968 | Himmelmann et al. | 430/621 |
| 3,623,878 | 11/1971 | Nishio et al. | 430/624 |
| 4,161,407 | 7/1979 | Campbell | 430/621 |
| 4,323,644 | 4/1982 | Nakamura et al. | 430/621 |
| 4,414,304 | 11/1983 | Dickerson | 430/353 |
| 4,425,425 | 1/1984 | Abbott et al. | 430/502 |
| 4,476,218 | 10/1984 | Ogawa et al. | 430/539 |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide photographic material having on a support at least one silver halide emulsion layer which contains light-sensitive tabular silver halide grains, with a ratio of grain diameter to grain thickness of 5 or more and a polymeric hardener. The silver halide photographic material has both increased covering power and scratching resistance, and is suitable for high-temperature rapid development processing.

17 Claims, No Drawings

SILVER HALIDE PHOTOGRAPHIC MATERIAL

FIELD OF THE INVENTION

The present invention relates to a photographic material and, more particularly, to a photographic material which has at least one silver halide emulsion layer containing light-sensitive tabular silver halide grains having a grain diameter to grain thickness ratio of at least about 5, and a polymeric hardener.

BACKGROUND OF THE INVENTION

Many photographic materials contain gelatin as the major component in most of their constituent layers, e.g., a silver halide light-sensitive emulsion layer, an emulsion protecting layer, a filter layer, an interlayer, an antihalation layer, a backing layer, a film base subbing layer, a baryta layer.

Such gelatin-containing light-sensitive materials are treated with aqueous solutions differing in pH or temperature, causing layers containing unhardened gelatin to swell excessively. Such swollen gelatin-containing materials scratch easily due to their tendency to absorb water and soften. In extreme cases, gelatin-containing layers are dissolved in high-temperature processing solutions, particularly at 30° C. or above, and are transferred from the light-sensitive materials into the processing solutions, which is highly undesirable.

A large number of hardening compounds are known to be effective in enhancing the water resistance, heat resistance and scratch resistance of gelatin layers. These compounds are well known as "hardeners" employed in the production of photographic materials, and include, for example, inorganic compounds like chrome alum, and organic compounds including aldehydes such as formaldehyde and glutaraldehyde, active halogen-containing compounds described in U.S. Pat. No. 3,288,775, compounds having reactive ethylenically unsaturated groups described in U.S. Pat. No. 3,635,718, aziridine series compounds decribed in U.S. Pat. No. 3,017,280, epoxy compounds described in U.S. Pat. No. 3,091,537 and halogenocarboxyaldehydes such as mucochloric acid.

However, photographic materials are also required to have heightened covering power (optical density obtained by a definite amount of coated silver). In order to increase covering power it is desirable to increase the swelling degree of silver halide emulsion layers at the time of development by using gelatin which is hardened to a lessened degree. By this means silver is saved and the required optical density is achieved using a minimum amount of coated silver.

The effect of enhancing covering power by decreasing the degree of hardening is notable particularly in high temperature processing. However, decreasing the degree of hardening as described above results in excessive swelling of the silver halide emulsion layers upon high temperature processing and consequently, the silver halide emulsion layers are likely to be scratched, or in extreme cases to be dissolved and removed. Therefore, the degree of hardening of a photographic material which is to be wet processed under high-temperature conditions is determined by balancing covering power ("degree of swelling") and scratch resistance ("scratching resistance").

If the thickness of the film when dried ("dry thickness") and its thickness when swollen ("wet thickness") are represented by d and $d+\Delta d$, respectively, then the "degree of swelling", which relates to covering power, can be determined by dividing the difference between wet thickness and dry thickness, $\Delta d$, by the dry thickness, d, to obtain $\Delta d/d$.

If a coated film in a swollen condition is scratched with a needle-like point as the load applied to the point is continuously increased, then "scratching resistance" is defined as the load applied to the coated film at its fracture point. The thus-defined "scratching resistance" closely describes the scratch resistance exhibited by a photographic material in wet development, fixation and washing processing. When this value is small, a film is scratched by contacting another film during development processing, and when using an automatic developing machine, delamination of a coated layer may be caused by contact with the carrying rollers.

In photographic materials having silver halide emulsion layers in which conventional silver halide grains are used, i.e., spherical grains, or polyhedral or twin grains having a spherical-like shape, the two contradictory requirements of a proper degree of swelling and a sufficient scratching resistance, can be satisfied by using conventional low molecular weight hardeners described above. However, in photographic materials having silver halide emulsion layers containing tabular silver halide grains with a large diameter to thickness ratio, a swelling degree equivalent to that of spherical grain-containing photographic materials results in a marked decrease of scratching resistance. Accordingly, when a photographic material has at least one silver halide emulsion layer containing tabular silver halide grains, its hardening degree must be increased to achieve a very low swelling degree and to improve its scratch resistance in a wet condition. As the result, the covering power is necessarily reduced.

A method of improving scratch resistance by using a particular hardener, such as a vinylsulfonyl group-containing ether, formaldehyde, or mucochloric acid in a tabular grain emulsion to achieve a greatly diminished swelling degree is described in Japanese Patent Application (OPI) No. 111933/83 (the term "OPT" as used herein refers to a "published unexamined Japanese patent application") (corresponding to U.S. Pat. No. 4,414,304).

However, this method has the disadvantage that the high covering power and high sensitivity inherent in a tabular grain emulsion are deteriorated by greatly diminishing the swelling degree.

SUMMARY OF THE INVENTION

An object of the present invention is to provide a photographic material which has at least one silver halide emulsion layer containing tabular silver halide grains having a diameter to thickness ratio of 5 or above, having improved scratch resistance during wet development processing.

A further object of the invention is to provide a photographic material with at least one silver halide emulsion layer containing such tabular silver halide grains, having excellent covering power achieved by an increased degree of swelling during wet processing.

These and other objects of the present invention are attained by hardening a light-sensitive silver halide emulsion layer, which contains tabular grains having a diameter to thickness ratio of about 5 or above as the major component of silver halide grains, with a polymeric hardener.

DETAILED DESCRIPTION OF THE INVENTION

The term "polymeric hardener" as used in the present invention includes compounds which have at least two electrophilic groups per molecule which reacts with gelatin, and a molecular weight (number average molecular weight) of about 10,000 or more.

Suitable examples of electrophilic groups that react with gelatin include aldehyde groups, epoxy groups, active halide groups (e.g., dichlorotriazine), active vinyl groups and active ester groups.

Although the objects of the invention can be obtained if at least two of the above-described electrophilic groups are present in each molecule of the polymeric hardener, superior results are obtained if each molecule in the polymeric hardener contains from about 10 to 5,000 of the above-described electrophilic groups. Preferably the molecular weight of the polymeric hardener is within the range of about 10,000 to about 500,000.

In general, hydrophilic polymeric hardeners are preferably used as the polymeric hardener having electrophilic groups capable of reacting with gelatin. However, non-hydrophilic polymeric hardeners can also be used in the form of an emulsified dispersion in a hydrophilic colloid such as gelatin (e.g., dissolving them in an organic solvent, and then dispersing the solution in a hydrophilic colloid).

Examples of polymeric hardeners which can be employed in the present invention include aldehyde group-containing polymers such as dialdehyde starch, polyacrolein and acrolein copolymers described in U.S. Pat. No. 3,396,029; epoxy group-containing polymers described in U.S. Pat. No. 3,623,878; dichlorotriazine group-containing polymers described in U.S. Pat. No. 3,362,827, and *Research Disclosure,* 17333 (1978); active ester group-containing polymers described in Japanese Patent Application (OPI) No. 66841/81; polymers containing active vinyl groups or precursors thereof as described in Japanese Patent Application (OPI) No. 142524/81, U.S. Pat. No. 4,161,407, Japanese Patent Application (OPI) No. 65033/79, and *Research Disclosure,* 16725 (1978). Of these polymers, polymers having active vinyl groups or the precursors thereof, especially those having active vinyl groups or the precursors thereof attached to the main chain of the polymer by means of a long spacer, as described in Japanese Patent Application (OPI) No. 142524/81, are preferred. Polymers having repeating units represented by the following general formula (I) are particularly preferred.

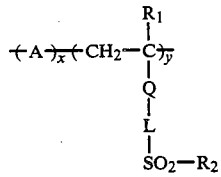

(I)

wherein A is a repeating unit which is formed by copolymerizing copolymerizable ethylenically unsaturated monomer.

The polymer of the formula (I) is described in Japanese Patent Application (OPI) No. 207243/82 (corresponding to U.S. patent application Ser. No. 388,820 filed June 16, 1982 and German Patent Application No. P 3,222,670.5) and Japanese Patent Application (OPI) No. 142524/81 (corresponding to U.S. patent application Ser. No. 251,827 filed Apr. 7, 1981).

The repeating unit A may be a single kind of copolymerized unsaturated monomer or a mixture of two or more kinds of copolymerized monomers. Suitable examples of the ethylenically unsaturated monomers in general formula (I) include styrene, hydroxymethylstyrene, sodium vinylbenzenesulfonate, N,N,N-trimethyl-N-vinylbenzylammonium chloride, α-methylstyrene, 4-vinylpyridine, N-vinylpyrrolidone, monoethylenically unsaturated esters of aliphatic acids (e.g., vinyl acetate), ethylenically unsaturated mono- or dicarboxylic acids or the salts thereof (e.g., acrylic acid, and methacrylic acid), maleic anhydride, esters of ethylenically unsaturated mono- or dicarboxylic acids (e.g., n-butylacrylate, N,N-diethylaminoethylmethacrylate, and N,N-diethyl-N-methyl-N-methacryloyloxyethylammonium p-toluenesulfonate), and ethylenically unsaturated mono- or dicarboxylic acid amides (e.g., acrylamide, sodium 2-acrylamido-2-methylpropanesulfonate and N,N-dimethyl-N'-methacryloylpropanediamine acetate betaine).

$R_1$ represents a hydrogen atom or a lower alkyl group containing 1 to 6 carbon atoms (e.g. methyl, ethyl, butyl, n-hexyl, etc.). Of these substituents, a hydrogen atom and methyl group are particularly preferred.

Q represents $-CO_2-$,

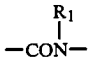

or an arylene group having 6 to 10 carbon atoms wherein $R_1$ has the same meaning as defined above. Of these groups, $-CO_2-$, $-CONH-$,

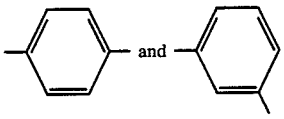

are particularly preferred.

L represents a divalent moiety having 3 to 15 carbon atoms and containing at least one group selected from the group consisting of $-CO_2-$, and

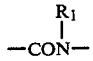

(wherein $R_1$ has the same meaning as defined above); or a divalent moiety having from 1 to 12 carbon atoms containing at least one group selected from the group consisting of

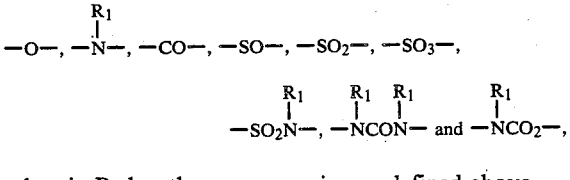

wherein $R_1$ has the same meaning as defined above.

Specific examples of L include $-CH_2CO_2CH_2CH_2-$, $-CH_2NHCOCH_2-$,

-continued $\text{+}CH_2\text{+}_{10}\text{—}NHCOCH_2CH_2\text{—}$, $\text{—}CH_2COCH_2CH_2\text{—}$,

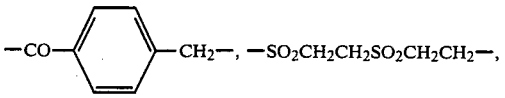

$\text{—}SO_2NHCH_2CH_2CO_2CH_2CH_2\text{—}$ and $\text{—}NHCONHCH_2CH_2\text{—}$.

$R_2$ represents a vinyl group or a functional precursor group thereof, and is either $\text{—}CH{=}CH_2$ or $\text{—}CH_2CH_2X$, wherein X represents a group capable of being substituted by a nucleophilic group, or a group capable of being released in the form of HX by reaction with a base.

Particularly preferred examples of the functional group $R_2$ include $\text{—}CH{=}CH_2$, $\text{—}CH_2CH_2Br$, $\text{—}CH_2CH_2Cl$, and

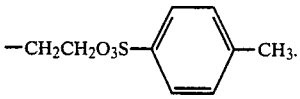

x and y represent mole percent, with x being from about 0 to 99, and y being from about 1 to 100. Preferably, x is from about 0 to 75, and y is from about 25 to 100.

Specific examples of the polymeric hardeners which can be employed are illustrated below, but the present invention is not to be construed as limited thereto.

P-1

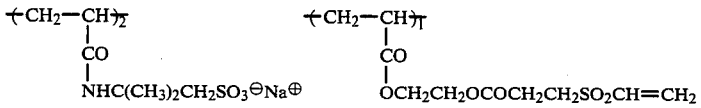

P-2

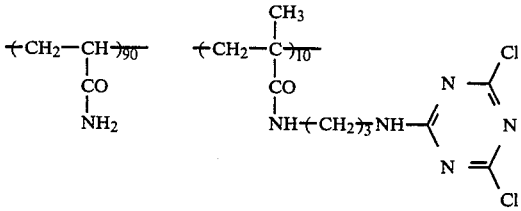

P-3

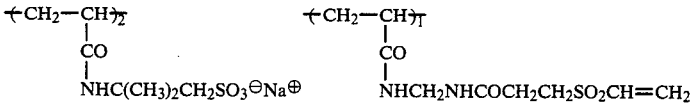

P-4

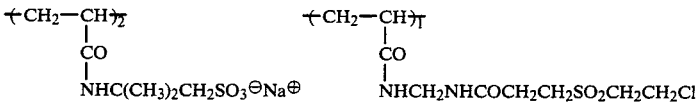

P-5

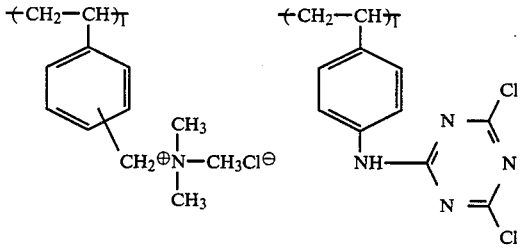

P-6

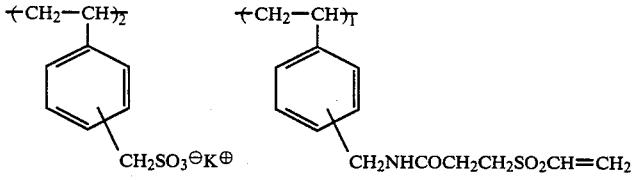

P-7

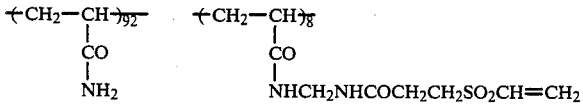

P-8

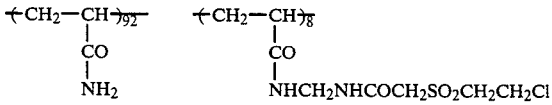

-continued
P-9
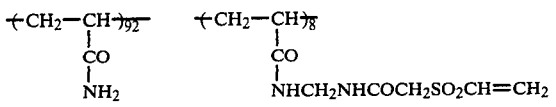
P-10
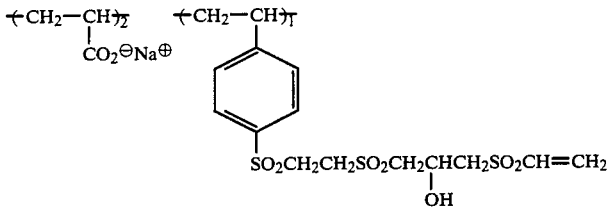
P-11
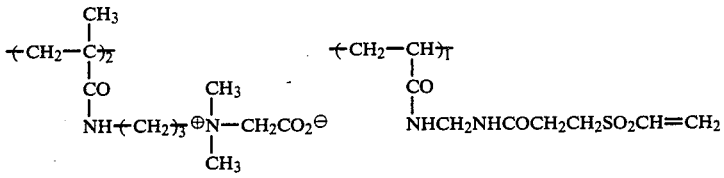
P-12
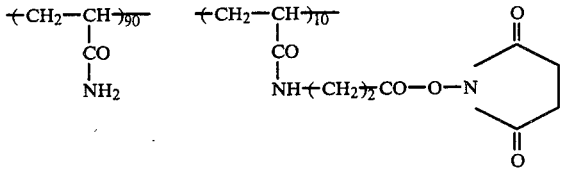
P-13
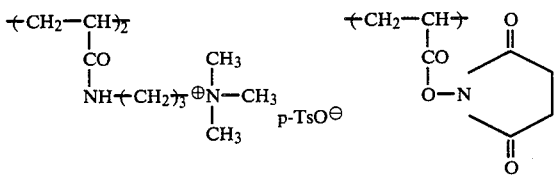
P-14
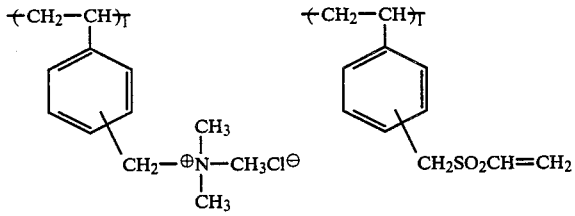
P-15
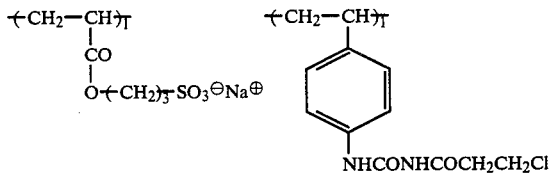
P-16
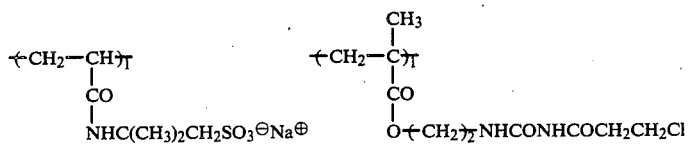
P-17
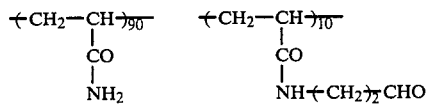

-continued

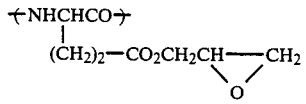

P-18

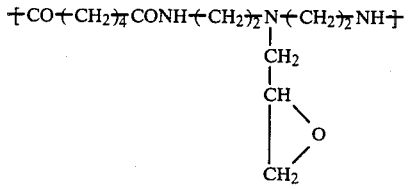

P-19

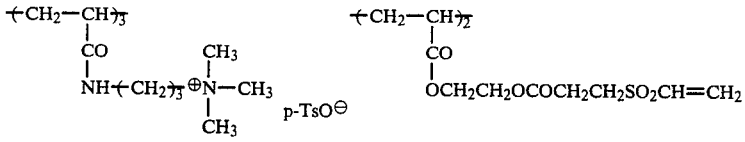

P-20

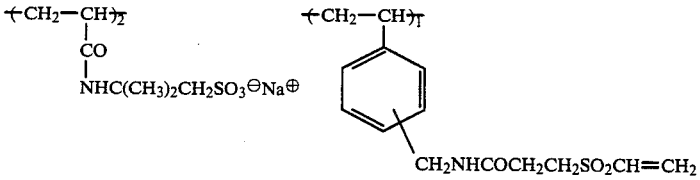

P-21

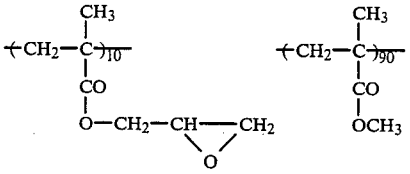

P-22

(numerals represent molar ratios of repeating units)

In addition to the polymeric hardeners described above, which have at least two electrophilic groups per molecule capable of reacting with gelatin, the combination of a gelatin hardener and a polymer capable of reacting with the gelatin hardener to form such a polymer having at least two electrophilic groups per molecule can be employed as the polymeric hardeners of the present invention. When the above-described combination is employed, a polymeric hardener according to the invention is produced in the coated silver halide emulsion layer.

Gelatin hardeners which can be used for producing such polymeric hardeners in emulsion layers in the above-described manner include the foregoing low molecular weight hardeners, and the low molecular weight hardeners described in T. H. James, *The Theory of the Photographic Process,* pp. 77–84 (4th ed., 1977). Of these low molecular weight hardeners, those having a vinylsulfone groups are preferred, especially those described in Japanese Patent Application (OPI) No. 41221/78.

Specific examples of gelatin hardeners which can be used in combination with polymers to provide the polymeric hardeners of the present invention are illustrated below, but the present invention should not be construed as being limited thereto.

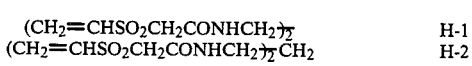

H-1

H-2

-continued

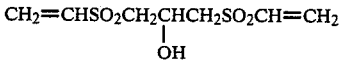

H-3

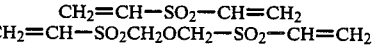

H-4

H-5

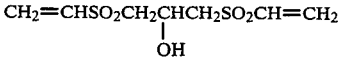

H-6

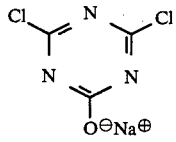

H-7

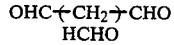

H-8

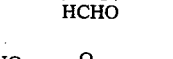

H-9

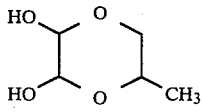

H-10

-continued

H-11

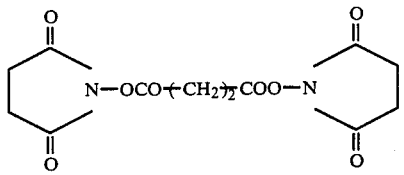

Polymers used in combination with the above-described gelatin hardeners for producing polymeric hardeners in an emulsion layer must have at least two nucleophilic groups per molecule capable of reacting with gelatin hardeners. Suitable examples include primary amino group-containing polymers described in British Pat. No. 2,011,912, sulfinic acid group-containing polymers described in Japanese Patent Application (OPI) No. 4141/81, phenolic hydroxyl group-containing polymers described in U.S. Pat. No. 4,207,109, and active methylene group-containing polymers described in U.S. Pat. No. 4,215,195. Of these polymers, those having sulfinic acid groups described in Japanese Patent Application (OPI) No. 4141/81 are particularly preferred.

Specific examples of the polymer capable of providing a polymeric hardener which can be employed in the present invention are illustrated below, although the present invention is not to be construed as being limited thereto.

Q-1

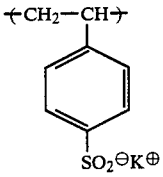

Q-2

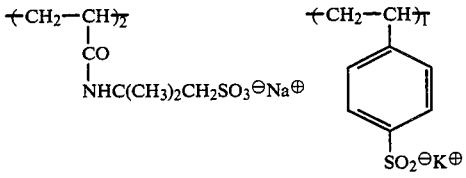

Q-3

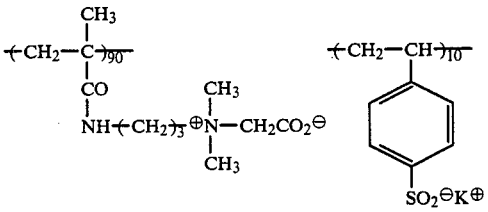

Q-4

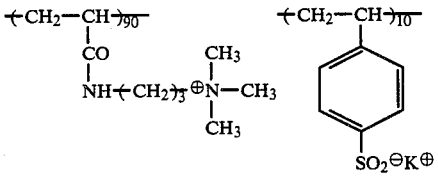

Q-5

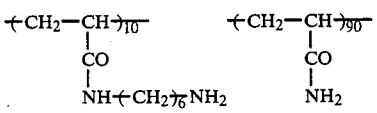

-continued

Q-6

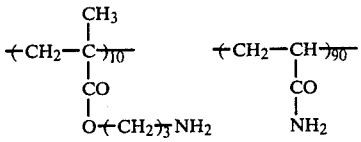

Q-7

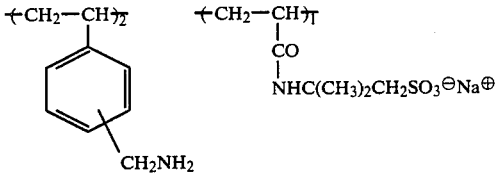

Q-8

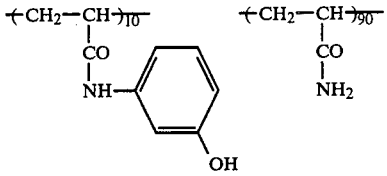

Q-9

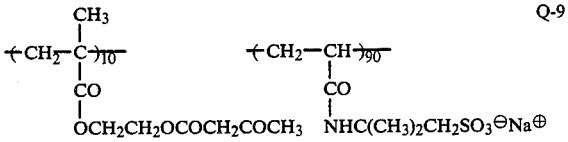

Specific synthesis examples of the polymers (polymeric hardeners) which can be employed in the present invention are described in detail below.

SYNTHESIS EXAMPLE 1

Synthesis of N-[3-(Chloroethylsulfonyl)propioyl]aminomethylacrylamide

In a 2-liter reaction vessel, 224 g of sodium sulfite and 220 g of sodium hydrogencarbonate were added to 1,400 ml of distilled water at room temperature, and dissolved therein with stirring and the solution was then cooled to 5° C. 260 g of chloroethanesulfonyl chloride was added dropwise to the solution at this temperature over a period of about one and half hour. At the conclusion of the dropwise addition, 160 g of 49% sulfuric acid was further added thereto to precipirate crystals. The thus-obtained crystals were filtered off, and washed with 400 ml of distilled water. The resulting filtrate and wash water were placed in a 3-liter reaction vessel and thereto a solution of 246 g of methylenebisacrylamide dissolved in a mixture of 480 ml of distilled water and 1,480 ml of ethanol was added dropwise over a period of about 30 minutes at a temperature of 5° C. The reaction mixture was allowed to stand for 5 days in a refrigerator at 7° C. to complete the reaction. Thereafter, the thus-deposited crystals were filtered off, washed with 800 ml of distilled water, and recrystallized from 2,000 ml of a 50% aqueous ethanol solution, to obtain 210 g of white powder. Yield 49%, Melting Point 192° C. or higher (decomposed).

SYNTHESIS EXAMPLE 2

Synthesis of N-[2-(Chloroethylsulfonyl)acetyl]aminomethylacrylamide

In a 1-liter reaction vessel, to 720 ml of methanol and 80.8 g of N-methylolacrylamide was added 40 ml of concentrated hydrochloric acid at room temperature with stirring. The stirring was continued for 16 hours. Thereafter, 0.4 g of hydroquinone monomethyl ether was added, and methanol was distilled away by means of an evaporator. To the oil remaining (62.4 g) were added 100 g of chloroethanesulfonyl acetamide, 0.32 g of hydroquinone monomethyl ether and 0.22 g of p-toluenesulfonic acid. The mixture was heated to 150° C. and methanol produced was removed by distillation. The reaction was brought to completion at this temperature in about 15 minutes. The remaining crystals were recrystallized from 250 ml of a 50% aqueous ethanol solution, to obtain 61 g of white powder in a 42% yield.

SYNTHESIS EXAMPLE 3

Synthesis of Poly-N-[3-(vinylsulfonyl)propioyl]aminomethylacrylamido-co-acrylamido-sodium-2-methylpropanesulfonate (P-3)

In a 200 ml reaction vessel, 5.65 g of the monomer produced in Synthesis Example 1, 9.16 g of acrylamido-sodium-2-methylpropanesulfonate and 80 ml of a 50% aqueous solution of ethanol were placed, dissolved with stirring at room temperature, and heated to 80° C. as nitrogen gas was passed therethrough. 0.1 g of 2,2'-azobis(2,4-dimethylvaleronitrile) was added to the mixture at 80° C., and it was allowed to stand for 30 minutes. Thereafter, the same amount of 2,2'-azobis(2,4-dimethylvanleronitrile) was further added, and the heating at the same temperature was continued for 1 hour with stirring. Then, the reaction mixture was cooled to 10° C. and a mixture of 2.5 g of triethylamine and 80 ml of ethanol was added. The resulting mixture was further stirred for 1 hour at 10° C. and then it was added to 1 liter of acetone to precipitate. The precipitate was filtered off and vacuum-dried, to obtain 12.4 g of a white polymer in a 85% yield. The limiting viscosity [$\eta$] of this polymer was 0.227, and a vinylsulfone content in this polymer was $0.95\times10^{-3}$ equivalent per 1 g of polymer.

SYNTHESIS EXAMPLE 4

Synthesis of Poly-N-[2-(vinylsulfonyl)acetyl]aminomethylacrylamido-co-acrylamide (P-7)

53.7 g of the monomer produced in Synthesis Example 2, 163.3 g of acrylamide and 1,955 g of methanol were placed in a 3,000-ml reaction vessel, dissolved at room temperature with stirring, and heated to 60° C. as nitrogen gas was passed therethrough. 6.2 g of 2,2'-azobis(2,4-dimethylvaleronitrile) was added to the reaction mixture. The mixture was heated for 4 hours at 60° C. and thereafter cooled to room temperature. 20.2 g of triethylamine was added to the mixture, which was stirred for 2 hours to precipitate. The resulting precipitates were filtered off, and vacuum-dried, to obtain 194.3 g of a white polymer in a 92.7% yield. The vinylsulfone content of this polymer was determined by an addition of thioglycolic acid to be $0.50\times10^{-3}$ equivalent per 1 g of polymer.

SYNTHESIS EXAMPLE 5

Synthesis of Poly-potassium-vinylbenzenesulfinate-coacrylamido-sodium-2-methylpropanesulfonate (Q-2)

In a 500-ml reaction vessel, 45.8 g of acrylamido-sodium-2-methylpropanesulfonate, 20.6 g of potassium vinylbenzenesulfinate, 90 ml of ethanol and 90 ml of distilled water were heated to 75° C. with stirring. 0.82 g of 2,2'-azobis(2-amine)propane dihydrochloride was added to the mixture, which was heated for 4 hours at 60° C. Then, it was cooled to room temperature and 72 ml of ethanol and 278 ml of distilled water were added. The resulting mixture was filtered, and a colorless, transparent, viscous liquid was obtained. This polymer solution had a viscosity of 3.25 cp at 25° C., a solid component concentration of 10.3 wt%, and a sulfinic acid content as determined by an addition of thioglycolic acid of $6.2\times10^{-6}$ equivalent per 1 g of polymer.

Other polymeric hardeners can be also synthesized on the basis of these synthesis examples or the methods described in the foregoing patent specifications.

The polymeric hardeners of the present invention can be used in any amount sufficient to meet the intended purpose. In general, they are used in amounts such that their functional groups that react with gelatin are present in the range of about $0.5\times10^{-3}$ equivalent to $5\times10^{-2}$ equivalent per 100 g of dried gelatin. The particularly preferred range is from about $0.5\times10^{-3}$ equivalent to $2\times10^{-2}$ equivalent per 100 g of dried gelatin.

The polymers of the present invention may be used alone as a hardener, or in combination with a low molecular weight hardener or a different polymeric hardener. Conventional hardeners which can be used in combination with the polymers of the present invention include reactive halogen-containing compounds such as 2-hydroxy-4,6-dichloro-1,3,5-triazine, reactive olefin-containing compounds such as divinylsulfone, isocyanates, aziridine compounds, epoxy compounds, mucochloric acid, chrome alum, and aldehydes.

The effect of the polymeric hardeners of the present invention upon photographic materials compared with that of low molecular weight hardeners becomes more remarkable with the greater swelling degree of the photographic materials. More specifically, when the swelling degree ranges from about 1.5 to 10, particularly from about 2 to 7, this effect becomes predominant.

Next, tabular silver halide grains to be employed in the present invention are described.

The diameter to thickness ratio of the tabular silver halide grains of the present invention is preferably about 5 or greater, more preferably ranges from about 5 to 50, and most preferably from about 8 to 30.

Herein, the term "diameter of silver halide grain" describes the diameter of a circle having an area equal to the projection area of the grain. A suitable diameter of tabular silver halide grains in the present invention ranges from about 0.5$\mu$ to 5.0$\mu$, preferably from about 1.0$\mu$ to 4.0$\mu$.

In general, tabular silver halide grains are fine flat particles having opposing parallel planar faces. Accordingly, the term "thickness" in the present invention refers to the distance between the two parallel planar faces of the tabular silver halide grain.

A preferred halide composition of the tabular silver halide grains is bromide or iodobromide, particularly iodobromide containing 30 mole% iodide or less.

The tabular silver halide grains can be prepared using a process or a combination of processes known in the art. For instance, seed crystals in which tabular grains are contained in a concentration of 40% or more by weight are formed in an atmosphere of comparatively low pBr value, e.g., pBr of 1.3 or below, and grown by adding silver and halogen solutions simultaneously as the pBr value is maintained at the same level as described above.

In the above-described grain-growth process, silver and halogen solutions should be added so as to prevent the formation of new crystal nuclei.

The size of the tabular silver halide grains can be controlled by adjusting the preparation temperature, proper selection of the kind and amount of solvent used, and controlling the rate of addition of silver salt and halides used at the time of grain-growth.

In producing the tabular silver halide grains of the present invention, the grain size, the grain form (e.g., diameter to thickness ratio), the grain size distribution and the grain-growth speed can be controlled by the use of a silver halide solvent, if desired. A preferred amount of the solvent to be used is $10^{31\ 3}$ to 1.0 wt%, particularly $10^{-2}$ to $10^{-1}$ wt%, based on the reaction solution.

Specifically, the grain size distribution tends to become more monodisperse with an increase in the amount of solvent used. On the other hand, increasing the amount of solvent tends to increase the thickness of the resulting grains.

Examples of silver halide solvents frequently used include ammonia, thioethers and thioureas, such as the thioethers disclosed in U.S. Pat. Nos. 3,271,157, 3,790,387, 3,574,628.

In producing the tabular silver halide grains of the present invention, methods of increasing the addition rates, the addition amounts, and the addition concentrations of silver salt solution (e.g., $AgNO_3$ aqueous solution) and halide solution (e.g., KBr aqueous solution) respectively in order to accelerate the grain growth can be advantageously employed.

Such methods are described, for example, in British Pat. No. 1,335,925, U.S. Pat. Nos. 3,672,900, 3,650,757 and 4,242,445, Japanese Patent Applications (OPI) Nos. 142329/80, 158124/80, 113927/83, 113928/83, 111934/83 and 111936/83.

The tabular silver halide grains of the present invention can be optionally subjected to chemical sensitization.

Chemical sensitization can be carried out using conventional processes. Specifically, a gold sensitization process using gold compounds (as described in, e.g., U.S. Pat. Nos. 2,448,060 and 3,320,069) or a sensitization process using a noble metal such as iridium, platinum, rhodium, or palladium (as described in, e.g., U.S. Pat. Nos. 2,448,060, 2,566,245 and 2,566,263), or a sulfur sensitization process using sulfur-containing compounds (as described in, e.g., U.S. Pat. No. 2,222,264), or a reduction sensitization process using stannous salts, polyamines, etc. (as described in, e.g., U.S. Pat. Nos. 2,487,850, 2,518,698 and 2,521,925) can be employed individually or in combination of two or more thereof.

From the standpoint of saving silver, it is particularly preferred for the tabular silver halide grains of the present invention to be subjected to gold sensitization, sulfur sensitization, or the combination thereof.

The tabular silver halide grains of the present invention are incorporated in the desired layer in a proportion of preferably about 40 wt% or more, and more preferably about 60 wt% or more, of the total amount of silver halide grains in said layer.

A preferred thickness of the layer containing the tabular silver halide grains is about 0.3 to 5.0μ, and more preferably about 0.5 to 3.0μ.

In addition, a preferred coating amount of the tabular silver halide grains (for a tabular silver halide emulsion layer being present on one side of a base support) is about 0.5 to 6 g/m$^2$, particularly about 1 to 4 g/m$^2$.

Other components included in the layer in which the tabular silver halide grains are contained are not particularly restricted and can include, for example, a binder, an anti-foggant, a silver halide-stabilizing agent, a surface active agent, a spectral sensitizing dye, a dye, an ultraviolet absorbent, a chemical sensitizer and other conventional additives described in *Research Disclosure,* Vol. 176, pp. 22–28 (December, 1978).

The emulsion layers of the silver halide photographic material of the present invention can contain ordinary silver halide grains in addition to tabular silver halide grains. Ordinary silver halide grains can be prepared using any of the various conventional methods described in, for example, P. Glafkides, *Chimie et Physique Photographique,* (Paul Montel, Paris, 1967), G. F. Duffin, *Photographic Emulsion Chemistry,* (The Focal Press, London, 1966). and V. L. Zelikman et al., *Making and Coating Photographic Emulsion* (The Focal Press, London, 1964). Specifically, the acid process, the neutral process or the ammonia process may be employed. Suitable methods for reacting a water-soluble silver salt with a water-soluble halide include, e.g., the single jet method or the double jet method or a combination thereof.

Also, a method in which silver halide grains are produced in the presence of excess silver ion (the "reversal mixing" method) can be employed. The "controlled double jet" method, in which the pAg of the liquid phase in which silver halide grains are to be precipitated is maintained constant, may be also employed.

Suitable examples of silver halides include silver bromide, silver iodobromide, silver iodochlorobromide, silver chlorobromide, and silver chloride.

In a process of producing silver halide grains or physically ripening the silver halide grains produced, cadmium salts, zinc salts, lead salts, thallium salts, iridium salts or complexes, rhodium salts or complexes, iron salts or complexes and/or the like may be present. Optionally, such conventional silver halide grains also can be chemically sensitized in the same manner as the tabular silver halide grains.

The photographic emulsions which can be employed in the present invention can contain a wide variety of additives for purposes of preventing fogging or stabilizing photographic functions during production, storage or processing, including, for example, various kinds of anti-foggants or a stabilizers, e.g., azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially 1-phenyl-5-mercaptotetrazole); mercaptopyrimidines; mercaptotriazines; thioketo compounds such as oxazolinethione; azaindenes, such as triazaindenes, tetraazaindenes (especially 1,3,3a,7-tetraazaindenes substituted by a hydroxyl group at the 4-position), and pentaazaindenes; and benzenethiosulfonic acids, benzenesulfinic acids, benzenesulfonic acid amides and the like. Specifically, those described in U.S. Pat. Nos. 3,954,474 and 3,982,947, and Japanese Patent Publication No. 28660/77 can be employed.

The photographic emulsions which are used in the present invention may be spectrally sensitized using methine dyes or other dyes.

Useful spectral sensitizing dyes include those described in German Pat. No. 929,080, U.S. Pat. Nos. 2,493,748; 2,503,776, 2,519,001, 2,912,329, 3,656,959, 3,672,897, 3,694,217, 4,025,349 and 4,046,572, British Pat. No. 1,242,588, and Japanese Patent Publications Nos. 14030/69 and 24844/77.

These sensitizing dyes may be employed individually or in combination. Combinations of sensitizing dyes are often employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,344,281 and 1,507,803, Japanese Patent Publications Nos. 4936/68 and 12375/78, and Japanese Patent Applications (OPI) Nos. 110618/77 and 109925/77.

Materials which can exhibit a supersensitizing effect in combination with a certain sensitizing dye although they themselves do not spectrally sensitize silver halide emulsions or do not absorb light in the visible region may be incorporated in the silver halide emulsion. For example, aminostilbene compounds substituted with nitrogen-containing heterocyclyl groups (as described in U.S. Pat. Nos. 2,933,390 and 3,635,721), aromatic organic acid-formaldehyde condensates (as described in U.S. Pat. No. 3,743,510), cadmium salts, and azaindene compounds can be used. Particularly useful combinations are disclosed in U.S. Pat. Nos. 3,615,613, 3,615,641, 3,617,295 and 3,635,721.

Color forming couplers can be also added to the photographic emulsion layers of the photographic material of the present invention. The term "color forming coupler" refers to a compound capable of forming color by the oxidative coupling with an aromatic primary amine developer (e.g., phenylenediamine derivatives, or aminophenol derivatives) upon color development processing. Specifically, 5-pyrazolone couplers, pyrazolobenzimidazole couplers, cyanoacetylcumarone couplers, and open-chain acylactonitrile couplers can be employed as magenta couplers; acylacetoamide couplers (e.g., benzoylacetoanilides and pivaloylacetoanilides) can be employed as yellow couplers; and naphthol couplers and phenol couplers can be employed as cyan couplers. Of these couplers, those which have a hydrophobic ballast group in the molecule and which are rendered nondiffusible thereby are advantages. Such couplers may be either 2-equivalent or 4-equivalent to silver ions. Colored couplers which have a color correction effect, or couplers capable of releasing a development inhibitor with the progress of development ("DIR couplers") may be incorporated in photographic emulsions.

In addition, colorless DIR coupling compounds which produce colorless products by the coupling reaction and release development inhibitors may be incorporated in the photographic emulsions.

The emulsion layer of the photographic material of the present invention is not particularly restricted as to other constituents, and various additives can be used therein as occasion calls. Specifically, binders, surface active agents, dyes, ultraviolet absorbents, coating aids, viscosity increasing agents, plasticizers and so on which are described in *Research Disclosure,* Vol. 176, pp. 22–28 (December 1978) can be used.

The photographic material of the present invention preferably has a surface protecting layer containing as its main component a synthetic or a natural macromolecular compound, such as gelatin, a water-soluble polyvinyl compound or an acrylamide polymer (as described in U.S. Pat. Nos. 3,142,568, 3,193,386 and 3,062,674).

In the surface protecting layer, a surface active agent, an antistatic agent, a matting agent, a lubricant, a hardener, a viscosity increasing agent and so on can be incorporated in addition to gelatin or other macromolecular substances.

The photographic material of the present invention can optionally have an interlayer, a filter layer or an antihalation layer, if desired.

In the photographic material of the present invention, the photographic emulsion layers and other constituent layers are coated on a flexible support, such as plastic films which have been conventionally used in photographic materials, paper, or cloth or a rigid support such as glass, ceramic, or metal. Examples of useful flexible supports include films made of semi-synthetic or synthetic high polymers such as nitrocellulose, cellulose acetate, cellulose acetate butyrate, polystyrene, polyvinyl chloride, polyethylene terephthalate or polycarbonate, sheets of paper on which a baryta layer or an $\alpha$-olefin polymer (e.g., polyethylene, polypropylene, or ethylene-butene copolymer) is coated or laminated. The support may be colored with a dye or a pigment. On the surface of the supports, a subbing layer is generally provided for the purpose of enhancing adhesiveness of the photographic emulsion layers. The surface of the support may be subjected to a corona discharge treatment, irradiation with ultraviolet rays, or flame treatment before or after providing a subbing layer thereon.

The present invention is not particularly restricted as to the method for coating on the support the layer containing the tabular silver halide grains, emulsion layers, a surface protecting layer, or other layers. However, it is preferred to employ simultaneous multilayer coating methods described in, e.g., U.S. Pat. Nos. 2,761,418, 3,508,947 and 2,761,791.

The photographic material of the present invention may have various layer structures. For example, in one embodiment the photographic material has (a) a layer containing the tabular silver halide grains of the present invention, (b) a conventional silver halide emulsion layer containing highly sensitive silver halide grains which are comparatively large (from about 0.5 to 3.0$\mu$) and which have a spherical or polyhedral form with a diameter to thickness ratio of less than 5, and (c) a surface protecting layer made up of gelatin or another high polymer are provided on a support, in that order. In another embodiment the photographic material comprises a support having coated thereon, in sequence, a layer containing the tabular silver halide grains, plural conventional silver halide emulsion layers and a surface protecting layer made up of gelatin. A further embodiment comprises a support having coated thereon, in sequence, one conventional silver halide emulsion layer, a layer containing tabular silver halide grains, a conventional silver halide emulsion layer having a high photographic speed, and a surface protecting layer made up of gelatin. A further embodiment includes a layer containing an ultraviolet absorbent or a dye, a layer containing tabular silver halide grains, a conventional silver halide emulsion layer, and a surface protecting layer made up of gelatin provided on a support, in that order.

Another embodiment includes a layer containing tabular silver halide grains and an ultraviolet absorbent or a dye, a conventional silver halide emulsion layer and a surface protecting layer made up of gelatin provided on a support, in that order. In these embodiments, each of the tabular silver halide grain-containing emulsion layer and the conventional silver halide grain-containing emulsion layer is not necessarily a single layer, but may be a plurality of silver halide emulsion layers sensitized spectrally in different wavelength regions.

The silver halide photographic materials of the present invention are not limited, and include not only black-and-white photographic materials such as X-ray photographic materials (for fluorography and for direct radiography), lithographic light-sensitive materials, black-and-white printing papers, black-and-white negative films, etc., but also color photographic materials such as color negative films, color reversal films, color paper and so on. The effect of the present invention is remarkable in any of the above photographic materials which are subjected to high temperature rapid development processing.

The photographic processing method applied to the photographic material of the present invention is not unduly limited, and any known method and any known processing solution, such as those described in *Research Disclosure,* Vol. 176, pp. 28–30 (December 1976) (RD-17643), can be employed. The photographic processing may be either a photographic processing for forming a silver image (black-and-white photographic processing) or a photographic processing for forming a dye image (color photographic processing), depending upon the photographic material used. The processing temperature is generally in the range of about 18° C. to about 50° C., but temperatures higher than about 50° C. or lower than about 18° C. may be employed, if desired.

The developing solution employed for black-and-white photographic processing can contain known developing agents, such as dihydroxybenzenes (e.g., hydroquinone), 3-pyrazolidones (e.g., 1-phenyl-3-pyrazolidone) or aminophenols (e.g., N-methyl-p-aminophenol), which can be used alone or in combination. The developing solution can contain, in addition to the above-described developing agents, known preservatives, alkali agents, pH buffering agents and anti-foggants and optionally, may contain dissolving aids, color toning agents, development accelerators (e.g., quaternary salts, hydrazine, and benzyl alcohol), surface active agents, defoaming agents, water softeners, hardeners (e.g., glutaraldehyde), additives.

The photographic emulsions of the present invention can also be processed by "lithographic" development-processing, if desired. The term "lithographic" development-processing describes development-processing in which development proceeds infectiously using, in general, dihydroxybenzenes as a developing agent in the presence of a low sulfite ion concentration for the purpose of photographic reproduction of line images or photographic reproduction of halftone images by means of dots (details of which are described in L. F. A. Mason, *Photographic Processing Chemistry,* pp. 163–165 (1966)).

In a special method of development-processing, a developing agent is incorporated in the photographic material, more specifically, in an emulsion layer and the resulting photographic material is treated in an alkaline aqueous solution to achieve development. Hydrophobic developing agents can be incorporated in an emulsion layer using the various methods described in *Research Disclosure,* Vol. 169 (RD-16928), U.S. Pat. No. 2,739,890, British Pat. No. 813,253 and West German Pat. No. 1,547,763. This development-processing may be carried out in combination with a silver salt stabilization treatment using a thiocyanate.

Suitable fixing solutions include all conventional solutions having generally-used compositions. Examples of fixing agents which can be used therein include thiosulfates, thiocyanates and organic sulfur compounds which have a fixing effect. These fixing solutions may contain water-soluble aluminum salts as a hardener.

Color images can be formed using conventional methods. For instance, a negative-positive process (as described in *Journal of the Society of Motion Picture and Television Engineers,* Vol. 61, pp. 667–701 (1953)); a color reversal process in which a negative silver image is first formed by development with a developing solution containing a black-and-white developing agent, followed by at least one uniform exposure or other appropriate fogging treatment, after which color development is carried out to provide a positive dye image; and a silver dye bleach process in which dye-containing photographic emulsion layers are developed after exposure to produce a silver image, and the dyes are bleached using the resulting silver image as a bleaching catalyst; can be employed.

A color developing solution is, in general, an alkaline aqueous solution containing a color developing agent. Suitable examples of color developing agents which can be used include known aromatic primary amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline).

In addition to the above-described color developing agents, those described in L. F. A. Mason, *Photographic Processing Chemistry,* pp. 226–229 (Focal Press, London, 1966), U.S. Pat. Nos. 2,193,015 and 2,592,364, and Japanese Patent Application (OPI) No. 64933/73 can be also employed.

A color developing solution may optionally contain various additives such as pH buffering agents, development inhibitors, anti-foggants, water softeners, preservatives, organic solvents, development accelerators, carboxylic acid series chelating agents, and other additives described in *Research Disclosure* (RD-17643), U.S. Pat. No. 4,083,723 and West German Patent Application (OLS) No. 2,622,950.

The polymeric hardeners of the present invention have a specific action, which low molecular hardeners do not possess, of increasing the scratching resistance of the emulsion layer containing tabular silver halide grains, which is obtained when either the method of adding the polymeric hardener to an emulsion layer, or the method of adding both a gelatin hardener and a polymer capable of reacting with the gelatin hardener to provide the polymeric hardener to an emulsion layer to produce a polymeric hardener therein is used.

Further, the polymeric hardeners produce this specific effect only in the emulsion layer containing tabular silver halide grains. In contrast, in the emulsion layer containing spherical silver halide grains, low molecular hardeners rather than polymeric hardeners according to the invention can heighten the scratching resistance.

Thus, silver halide photographic materials excellent in both covering power (i.e., sensitivity) and scratch resistance are obtained by the present invention in which the emulsion layer containing tabular silver halide grains is hardened with a polymeric hardener.

The remarkable increase in scratching resistance produced by the polymeric hardener is characteristic of the gelatin layer containing tabular silver halide grains, and it was entirely unforeseeable from conventional hardening techniques.

This effect is most remarkable in a high temperature rapid processing (e.g., at a temperature of 28° C. or higher within a period of 30 seconds).

The present invention is explained in greater detail by reference to the following examples, but the present invention should not be construed as being limited thereto. Unless otherwise indicated, all parts, percents and ratios are by weight.

EXAMPLE 1

A photographic material was prepared in the following manner.

In a vessel kept at 70° C., 30 g of gelatin, 10.3 g of potassium bromide and 10 ml of a 0.5 wt% aqueous solution of thioether having the formula of $HO(CH_2)_2S(CH_2)_2S(CH_2)_2OH$ were added to 1 liter of water (wherein pAg was 9.1 and pH was 6.5), and stirred. Solutions I and II described below were simultaneously added to the reaction mixture over a 15 second period with stirring after which Solutions III and IV were added simultaneously over a 65 minute period using a double jet method.

In addition, Solution V was added over a 15 minute period at the same time as Solutions III and IV (10 minutes after the start of the addition of Solutions III and IV).

| | Composition of Solutions | | | | |
|---|---|---|---|---|---|
| Ingredient | Solution I | Solution II | Solution III | Solution IV | Solution V |
| $AgNO_3$ (g) | 4.5 | — | 95.5 | — | — |
| $H_2O$ (ml) | 30 | 26.7 | 561 | 542 | 100 |
| KBr (g) | — | 3.15 | — | 69.6 | — |
| KI (g) | — | — | — | — | 2.0 |
| 5 wt % Aqueous Solution of $HO(CH_2)_2S(CH_2)_2S(CH_2)_2OH$ (ml) | — | 0.45 | — | 12.5 | — |

The thus-obtained tabular silver halide grains had a mean diameter of 2.0μ and a mean diameter to thickness ratio of 16, and contained 2.0 mole% of silver iodide. After the combined chemical sensitization of gold and sulfur sensitizations, an anti-foggant (4-hydroxy-6-methyl-1,3,3a,7-tetraazaindene), a coating aid (dodecylbenzenesulfonate) and a viscosity increasing agent (polypotassium-p-vinylbenzenesulfonate) were added to the resulting emulsion to prepare a coating composition having a silver to gelatin ratio of 1.05 by weight.

Next, spherical grains of silver iodobromide (iodide content: 2.0 mole%, mean grain size: 1.45 μm) were formed in the presence of ammonia using a double jet method, and chemically sensitized with a chloroaurate and sodium thiosulfate. After the conclusion of chemical sensitization, anti-foggants (1-phenyl-5-mercaptotetrazole and 4-hydroxy-6-methyl-1,3,3a,7-tetraazaindene), a coating aid (dodecylbenzenesulfonate) and a viscosity increasing agent (polypotassium-p-vinylbenzenesulfonate) were added to the resulting emulsion to prepare a second coating composition having a silver to gelatin ratio of 1.05 by weight.

Samples (1) to (9) were prepared by adding the polymeric hardeners and the low molecular hardeners set forth in Table 1 to the tabular silver halide emulsion and the spherical silver halide emulsion, respectively, and coating these emulsions on polyethylene terephthalate supports simultaneously with the coating of a surface protecting layer. The thus-produced samples were then dried to produce Photographic Materials (1) to (9). The surface protecting layer was formed using a 10 wt% aqueous gelatin solution containing sodium polystyrenesulfonate, fine particles of polymethyl methacrylate (mean particle size: 3.0 μm), saponin in addition to gelatin.

In these photographic materials, the silver amount coated in the silver halide emulsion layer was 3.0 g/m², the gelatin amount coated in the surface protecting layer was 1.3 g/m², and the thickness of the surface protecting layer was 1.0 μm. These samples were stored for 10 days after the conclusion of the coating process at 25° C. and 65% RH. Each of the resulting samples was examined to determine its swelling degree and scratching resistance.

Measurement of Swelling Degree:

One set of each sample was dipped in Developing Solution A warmed to 35° C., and swollen for 30 seconds. Then, the swelling degree as defined by the following equation was determined:

$$Q = \frac{\text{Thickness increased by swelling}}{\text{Thickness in dried condition}}$$

Measurement of Scratching Resistance:

After dipping another set of each sample in Developing Solution A described below for 20 seconds at 35° C., a stainless steel stylus having a tip measuring 0.8 mm in radius was pressed on the sample surface, and a load applied to the tip was increased continuously within the range of 50 to 200 g as the tip was moved across the surface of the sample film at a speed of 1 cm a second until a surface fracture occurred. The load imposed on the stylus at the point where fracture occurred in the sample surface was measured.

The results obtained are shown in Table 1.

Developing Solution A:

| | |
|---|---|
| 1-Phenyl-3-pyrazolidone | 1.5 g |
| Hydroquinone | 30 g |
| 5-Nitroindazole | 0.25 g |
| Potassium Bromide | 3.7 g |
| Anhydrous Sodium Sulfite | 50 g |
| Potassium Hydroxide | 20 g |
| Boric Acid | 10 g |
| 25% Aqueous Solution of Glutaraldehyde | 20 ml |
| Water to make | 1 l |
| (pH was adjusted to 10.20) | |

TABLE 1

| Sample | Silver Halide Grain | Hardener Kind | Hardener Addition Amount (meq/100 g dry gel.) | Swelling Degree Q | Scratching Resistance (g) | Remark |
|---|---|---|---|---|---|---|
| (1) | Tabular | Low Molecular H-1 | 2.46 | 3.3 | 83 | Comparison |
| (2) | " | Low Molecular H-1 | 4.10 | 2.7 | 115 | " |
| (3) | " | Low Molecular I-1 | 3.35 | 3.3 | 80 | " |
| (4) | " | Low Molecular I-2 | 3.62 | 3.4 | 78 | " |
| (5) | " | Low Molecular I-3 | 2.32 | 3.2 | 82 | " |
| (6) | " | High Molecular P-3 | 1.65 | 3.2 | 144 | Invention |
| (7) | " | High Molecular P-7 | 1.80 | 3.4 | 132 | " |
| (8) | Spherical | Low Molecular H-1 | 3.05 | 3.4 | 176 | Comparison |
| (9) | " | High Molecular P-3 | 2.30 | 3.4 | 149 | " |

Hardeners Used in Comparison Examples:

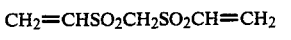

I-1

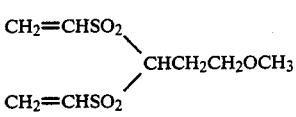

I-2

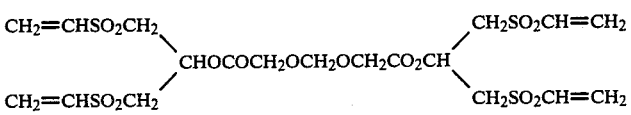

I-3

Comparison of Sample (1) and Sample (8) in Table 1 shows that when the low molecular hardener was used the sample containing tabular silver halide grains and the sample containing spherical silver halide grains differed greatly in the resulting scratching resistance. That is, when the swelling degrees were approximately equal (i.e., 3.3 and 3.4, respectively), the scratching resistance of the gelatin layer containing spherical grains was more than twice as great as that of the gelatin layer containing tabular grains. In addition, Sample (2) demonstrates that even when Q was considerably decreased by increasing the amount of the hardener added to the gelatin layer containing the tabular grains, the scratching resistance was only increased to 115.

Moreover, when Samples (1) to (5) are compared with Samples (6) and (7) (this invention), it is seen that the low molecular hardeners in Samples (3) to (5) had no greater effect than the low molecular hardener used in Sample (1), while Samples (6) and (7) according to the invention had a significantly greater scratching resistance for the equivalent Q value.

Furthermore, as can be seen from the comparison of Sample (8) and Sample (9), the polymeric hardener surprisingly decreased rather than increased the scratching resistance of the gelatin layer containing spherical silver halide grains when the Q values were the same.

Photographic Materials (1), (2), (6) and (7) were optically exposed using a light source having an emission peak at 410 nm through a continuous wedge, and thereafter they were development-processed with Developing Solution A at 35° C. for 25 seconds and subsequently fixed, washed with water and dried. The thus-processed photographic matrials were examined to determine maximum density attained, $D_{max}$, and photographic speed. The results obtained are set forth in Table 2. The photographic speed was defined as the logarithm of the reciprocal of the exposure necessary to obtain a blackening degree of fog+0.5. The fog value employed therein was a net value after base density was subtracted.

TABLE 2

| Photographic Material | Fog Value | Photographic Speed (Δ log E) | $D_{max}$ | Remark |
|---|---|---|---|---|
| (1) | 0.05 | (reference) | 2.20 | Comparison |
| (2) | 0.05 | −0.05 | 1.95 | " |
| (6) | 0.05 | 0 | 2.18 | Invention |
| (7) | 0.05 | +0.01 | 2.25 | " |

As can be seen from the comparison of data in Table 1 and Table 2, although decrease in both $D_{max}$ and photographic speed was caused by reinforcing the scratching resistance with the low molecular hardener (Sample 2), the use of the polymeric hardener in the present invention does not impair these photographic characteristics, and is quite advantageous from the standpoint of increase in scratching resistance.

EXAMPLE 2

A tabular silver halide emulsion was prepared in the same manner as in Example 1 to which Polymer (Q-5) described in Synthesis Example 5 was added. The vinylsulfone series Hardener (H-1) employed in Photographic Material (1) of Example 1 was added to the resulting emulsion just before coating, and the thus-prepared emulsion was coated simultaneously with the coating of a surface protecting layer as in Example 1, and dried, to obtain Samples (11), (12), (13) and (14), which differed in amounts of the polymer and the hardener added. The amount of silver coated in the silver halide emulsion layer was 3.0 g/m$^2$. After preparation, these materials were stored at a temperature of 25° C. and at a relative humidity of 65%. Ten days after, the swelling degrees and scratching resistances of these photographic materials were measured using the same methods as employed in Example 1.

Addition amounts of the polymer and the vinyl-sulfone series hardener, and results of the measurements are shown in Table 3.

TABLE 3

| Sample | Polymer Kind | Polymer Addition Amount (meq/100 g dry gel.) | Low Molecular Hardener Kind | Low Molecular Hardener Addition Amount (meq/100 g dry gel.) | Swelling Degree Q | Scratching Resistance (g) | Remark |
|---|---|---|---|---|---|---|---|
| (10) | — | — | H-1 | 2.62 | 3.2 | 86 | Comparison |
| (11) | Q-2 | 2.06 | " | 6.56 | 3.4 | 136 | Invention |
| (12) | " | " | " | 9.84 | 3.2 | 185 | " |
| (13) | " | 4.11 | " | 8.20 | 3.3 | 131 | " |
| (14) | " | " | " | 12.30 | 3.2 | 186 | " |

*Values determined based on the amount of sulfinic acid.

The results in Table 3 demonstrate that the combined use of a gelatin hardener and the polymer having at least two electrophilic groups per molecule that is capable of reacting with a gelatin hardener to provide a polymeric hardener also results in a surprising increase in scratching resistance, and can fully achieve the object of the present invention.

EXAMPLE 3

Emulsions containing tabular silver halide grains and spherical silver halide grains, respectively, were prepared in the same manner as in Example 1, and the hardeners described in Table 3 were added in the amounts described. On a polyethylene terephthalate support, a layer of the thus-prepared tabular silver halide grain-containing emulsion, a layer of the thus-prepared spherical silver halide grain-containing emulsion, and a surface protecting layer were coated simultaneously, in that order, and dried, to obtain Photographic Materials (15) to (17). The amount of silver coated in the emulsion layer containing tabular silver halide grains, which was the lowest layer, was 1.4 g/m$^2$, that of the spherical grain-containing layer (intermediate layer) was 2.0 g/m$^2$, and the coating amount of gelatin in the surface protecting layer (top layer) was 1.3 g/m$^2$. After coating, these photographic materials were allowed to stand for 10 days at 25° C. and 65% relative humidity. Thereafter, the swelling degrees and scratching resistances of the samples were measured using the same methods as in Example 1. The results obtained are shown in Table 4.

TABLE 4

| Sample | Spherical Grain-Containing Emulsion Layer Hardener | Spherical Grain-Containing Emulsion Layer Addition Amount (meq/100 g dry gel.) | Tabular Grain-Containing Emulsion Layer Hardener | Tabular Grain-Containing Emulsion Layer Addition Amount (meq/100 g dry gel.) | Swelling Degree Q | Scratching Resistance (g) | Remark |
|---|---|---|---|---|---|---|---|
| (15) | H-1 | 2.10 | H-1 | 2.10 | 3.4 | 79 | Comparison |
| (16) | " | 2.10 | P-3 | 1.60 | 3.3 | 108 | Invention |
| (17) | " | 1.05 | " | 3.00 | 3.3 | 128 | Invention |

The data set forth in Table 4 show that in the case of multilayer coating as well, the effect of the present invention is fully achieved by using the polymeric hardener in the emulsion layer containing the tabular silver halide grains.

EXAMPLE 4

Photographic Materials (18) and (19) were prepared in the same manner as in Example 1 except that Polymeric Hardener P-2 and Polymeric Hardener P-12, respectively, were used in an amount of 1.7 meq/100 g dry gelatin in place of using the Polymeric Hardener P-3 in an amount of 1.65 meq/100 g dry gelatin.

These materials were allowed to stand for 10 days at 25° C. and 65% relative humidity, similar to the conditions in Example 1. Thereafter, the swelling degrees and scratching resistances of the resulting materials were measured.

Photographic Materials (18) and (19) had the same swelling degree of 3.2, and demonstrated greatly improved scratching resistances, similar to those prepared in Example 1, compared with the inferior level attained by the use of low molecular hardeners.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having coated thereon at least one silver halide emulsion layer containing tabular silver halide grains, having a ratio of grain diameter to grain thickness of about 5 or more, and a polymeric hardener, wherein the polymeric hardener has a swelling degree range from about 2 to 7, wherein said swelling degree is determined by a process comprising incubating the photographic material at 25° for 10 days at 65 percent relative humidity, measuring layer thickness (d), immersing said photographic material in developing solution A at 35° C. for 30 seconds, measuring layer thickness (d to $+\Delta d$) and determining the percent change in layer thickness (d to $\Delta d$) as compared to the layer thickness (d), wherein the developing solution A comprises: 1-Phenyl-3-pyrazolidone (1.5 g), hydroquinone (30 g), 5-Nitroindazole (0.25 g), potassium bromide (3.7 g), anhydrous sodium sulfate (50 g), potassium hydroxide (20 g), boric acid (10 g), 25% aqueous solution of glutaraldehyde (20 ml) and water to make 1 l (pH is adjusted to 10.20).

2. The silver halide photographic material claimed in claim 1, wherein said polymeric hardener has at least two electrophilic groups per molecule capable of reacting with gelatin, and a number average molecular weight of about 10,000 or more.

3. The silver halide photographic material claimed in claim 2, wherein said polymeric hardener contains from about 10 to 5,000 electrophilic groups per molecule.

4. The silver halide photographic material claimed in claim 2, wherein said polymeric hardener has a molecular weight of from about 10,000 to about 500,000.

5. The silver halide photographic material claimed in claim 1, wherein said polymeric hardener is an aldehyde group-containing polymer, an epoxy group-containing polymer, a dichlorotriazine group-containing polymer, an active ester group-containing polymer, or a polymer containing active vinyl groups or precursors thereof.

6. The silver halide photographic material claimed in claim 1, wherein said polymeric hardener is represented by general formula (I)

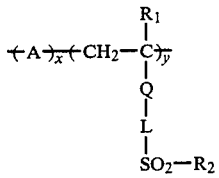

(I)

wherein A is a repeating unit which is formed by copolymerizing copolymerizable a ethylenically unsaturated monomer; $R_1$ is a hydrogen atom or a lower alkyl group containing 1 to 6 carbon atoms; Q is $—CO_2—$,

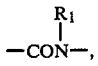

or an arylene group having 6 to 10 carbon atoms; L is a divalent linking group having 3 to 15 carbon atoms and containing at least one $—CO_2—$ or

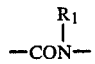

moiety, or a divalent linking group having from 1 to 12 carbon atoms and containing at least one group selected from the group consisting of

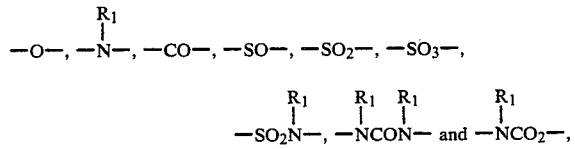

wherein $R_1$ has the same meaning as defined above; $R_2$ represents a vinyl group or a functional precursor group thereof selected from the group consisting of $—CH=CH_2$ or $CH_2CH_2X$ wherein X is a group capable of being substituted by a nucleophilic group, or a group capable of being released in the form of HX by reaction with a base; x and y represent mole%, with x being from about 0 to 99 and y being from about 1 to 100.

7. The silver halide photographic material claimed in claim 6, wherein $R_1$ is a hydrogen or a methyl group; Q represents $—CO_2—$, —CONH—,

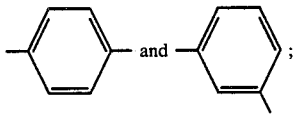

L is selected from the group consisting of $—CH_2CO_2CH_2CH_2—$, $—CH_2NHCOCH_2—$, -continued $—(CH_2)_{10}—NHCOCH_2CH_2—$, $—CH_2COCH_2CH_2—$,

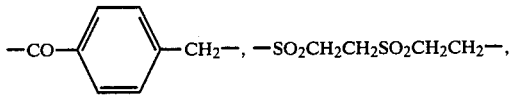

$—SO_2NHCH_2CH_2CO_2CH_2CH_2—$, and $—NHCONHCH_2CH_2—$; $R_2$ is selected from the group consisting of $—CH=CH_2$, $—CH_2CH_2Br$, $—CH_2CH_2Cl$, and

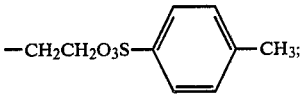

x is from about 0 to 75 and y is from about 25 to 100.

8. The silver halide photographic material claimed in claim 1, wherein said silver halide emulsion layer contains a gelatin hardener and a polymer capable of reacting with the gelatin hardener to form said polymeric hardener having at least two electrophilic groups per molecule which react with gelatin.

9. The silver halide photograhic material claimed in claim 8, wherein said polymer capable of reacting with the gelatin is a primary amino group-containing polymer, a sulfinic acid group-containing polymer, a phenolic hydroxyl group-containing polymer, or an active methylene group-containing polymer.

10. The silver halide photographic material claimed in claim 1, wherein said polymeric hardener is present in an amount such that the functional groups capable of reacting with gelatin are present in an amount of about $0.5\times10^{-3}$ equivalent to $5\times10^{-2}$ equivalent per 100 g of dried gelatin.

11. The silver halide photographic material claimed in claim 10, wherein said polymeric hardener is present in an amount such that the functional groups capable of reacting with gelatin are present in an amount of from about $0.5\times10^{-3}$ equivalent to $2\times10^{-2}$ equivalent per 100 g of dried gelatin.

12. The silver halide photographic material claimed in claim 1, wherein said tabular silver halide grains have a ratio of grain diameter to grain thickness of from about 5 to 50.

13. The silver halide photograhic material claimed in claim 12, wherein said tabular silver halide grains have a ratio of grain diameter to grain thickness of from about 8 to 30.

14. The silver halide photographic material claimed in claim 1, wherein said silver halide emulsion layer containing tabular silver halide grains contains spherical silver halide grains, and the tabular silver halide grains constitute at least about 40 wt% of the total amount of silver halide grains in said layer.

15. The silver halide photographic material claimed in claim 14, wherein said tabular silver halide grains constitute at least about 60 wt% of the total amount of silver halide grains in said layer.

16. The silver halide photograhic material claimed in claim 1, wherein said tabular silver halide grains are coated in an amount of from about 0.5 to 6 $g/m^2$.

17. The silver halide photographic material claimed in claim 16, wherein said tabular silver halide grains are coated in an amount of from about 1 to 4 $g/m^2$.

* * * * *